US006638055B2

(12) United States Patent
Carroni et al.

(10) Patent No.: US 6,638,055 B2
(45) Date of Patent: Oct. 28, 2003

(54) DEVICE FOR BURNING A GASEOUS FUEL/OXIDANT MIXTURE

(75) Inventors: Richard Carroni, Niederrohrdorf (CH); Adnan Eroglu, Untersiggenthal (CH); Timothy Griffin, Ennetbaden (CH); Verena Schmidt, Baden (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/135,007

(22) Filed: Apr. 30, 2002

(65) Prior Publication Data

US 2002/0197580 A1 Dec. 26, 2002

Related U.S. Application Data

(60) Provisional application No. 60/286,995, filed on Apr. 30, 2001.

(30) Foreign Application Priority Data

Dec. 14, 2001 (CH) ..... 2001 2298/01

(51) Int. Cl.[7] ..... F23M 3/00; F23Q 11/00

(52) U.S. Cl. ..... 431/9; 431/268; 431/353

(58) Field of Search ..... 431/8, 9, 170, 431/182, 183, 185, 268, 326, 353

(56) References Cited

U.S. PATENT DOCUMENTS

| | | | | |
|---|---|---|---|---|
| 5,202,303 A | | 4/1993 | Retallick et al. | |
| 5,328,359 A | | 7/1994 | Retallick | |
| 5,512,250 A | * | 4/1996 | Betta et al. | 422/173 |
| 5,518,697 A | * | 5/1996 | Dalla Betta et al. | 422/173 |
| 5,601,426 A | * | 2/1997 | Pfefferle | 431/170 |
| 5,634,784 A | * | 6/1997 | Pfefferle et al. | 431/7 |
| 5,817,909 A | * | 10/1998 | Lescuyer et al. | 588/205 |
| 5,876,196 A | * | 3/1999 | Knopfel et al. | 431/183 |
| 6,179,608 B1 | | 1/2001 | Kraemer et al. | |

FOREIGN PATENT DOCUMENTS

| | | |
|---|---|---|
| DE | 42 02 018 C1 | 4/1993 |
| EP | 0 620 402 A1 | 10/1994 |
| EP | 0 767 345 A2 | 4/1997 |
| EP | 0 833 105 A2 | 4/1998 |
| JP | A-59-136140 | 8/1984 |
| JP | A-2-259331 | 10/1990 |

* cited by examiner

*Primary Examiner*—Alfred Basichas
(74) *Attorney, Agent, or Firm*—Burns, Doane, Swecker & Mathis, L.L.P.

(57) ABSTRACT

A device for burning a gaseous fuel/oxidant mixture, in particular for a power plant installation, includes a catalyzer/swirl generator arrangement. Part of the fuel/oxidant mixture is burned in the catalyzer/swirl generator arrangement and the catalyzer/swirl generator arrangement generates a swirl flow. The catalyzer/swirl generator arrangement includes several flow channels, of which some are constructed catalytically active and others catalytically inactive. The flow channels can be arranged distributed around a longitudinal central axis of the catalyzer/swirl generator arrangement, and can be slanted relative to the axis.

18 Claims, 3 Drawing Sheets

DEVICE FOR BURNING A GASEOUS FUEL/OXIDANT MIXTURE

This application claims priority under 35 U.S.C. §§119 and/or 365 to 2001 2298/01 filed in Switzerland on Dec. 14, 2001; the entire content of which is hereby incorporated by reference. This application claims priority under 35 U.S.C. §119 to U.S. Provisional Application No. 60/286,995 entitled CATALYTIC STRUCTURE FOR HOMOGENEOUS FLAME STABILISATION and filed on Apr. 30, 2001, the entire content of which is hereby incorporated by reference.

FIELD OF THE INVENTION

The invention relates to a device for burning a gaseous fuel/oxidant mixture, in particular for a power plant installation.

BACKGROUND OF THE INVENTION

EP 0 833 105 A2 discloses a premix burner, in which a conical inner body that converges in the flow direction is arranged in an inside chamber. An outer enclosure of the inside chamber is interrupted by tangentially positioned air engagement channels, through which a combustion air flow flows into the inside chamber. As a result, a swirl flow is able to form in the inside chamber, which swirl flow is then enriched by means of at least one fuel nozzle with a fuel. The mixture of both media is then formed in the following mixing pipe. The mixing pipe then changes, via a cross-section increase, into a combustion chamber, whereby a reflux zone that ensures the combustion stability then forms in the region of the plane of the cross-section increase. In order to construct such a mixing pipe, the known premix burner requires a relatively large installation space. In the absence of the mixing pipe, the stability and homogeneity of the flames in the combustion chamber is reduced. There is also a risk of pressure pulsations.

U.S. Pat. Nos. 5,202,303 and 5,328,359 disclose catalyzers constructed from corrugated or folded web material, whereby their folds or corrugations form a plurality of flow channels. A fuel/oxidant mixture is partially burned when flowing through such a catalyzer. In order to prevent overheating in such a catalyzer, the combustion must be limited to only part of the mixture flowing through the catalyzer. For this purpose, only some of the channels are constructed catalytically active, for example by way of an appropriate coating, while the other channels are catalytically inactive. When flowing through the catalyzer, combustion then takes place only inside the catalytically active channels, while the catalyzer is cooled by flowing through the catalytically inactive channels. In conventional catalyzers, the catalyzer outlet temperatures are too low, however, to sufficiently stabilize the flames in the combustion chamber.

SUMMARY OF THE INVENTION

In view of the above disadvantages of the prior art, the invention is directed to a device that provides a compact construction and stability and homogeneity of the flames in the combustion chamber.

The invention is based on the general idea of creating a swirl flow from the fuel/oxidant mixture and increasing the temperature of the mixture prior to its entrance into the combustion chamber by use of a catalyzer. For this purpose, the device according to the invention comprises a flow-enabling catalyzer/swirl generator arrangement, in which part of the fuel/oxidant mixture is burned and which generates a swirl flow. The invention makes it possible to increase the stability and homogeneity of the flames in the combustion chamber and to reduce the pulsation risk. In addition, such a catalyzer/swirl generator arrangement may have a relatively short construction in the flow direction, so that the device overall has a compact construction.

In principle, it is possible to construct the catalyzer/swirl generator arrangement in such a way that it has a catalyzer and, immediately following the catalyzer in a downstream direction, a swirl generator. However, an embodiment in which the catalyzer/swirl generator arrangement comprises a catalyzer constructed as a swirl generator is preferred. In other words, the catalyzer or catalyzer body is constructed in such a way that the flow exiting from it has the desired swirl. With this construction, two functions, i.e., the catalytic combustion and the swirl generation, can be integrated into a compact component.

It is useful that the catalyzer/swirl generator arrangement comprises several flow channels extending essentially parallel, i.e., in the same direction, to each other, of which some, in particular approximately half, are constructed catalytically active, and the others catalytically inactive. The channels may be arranged distributed around a longitudinal center axis of the catalyzer/swirl generator arrangement, whereby this longitudinal center axis extends in the main flow direction of the catalyzer/swirl generator arrangement. According to an advantageous embodiment, the channels can be slanted in relation to the longitudinal center axis in such a way that the longitudinal direction of the channels in each case extends slanted in relation to a straight line that extends parallel to the longitudinal center axis. This results in an arrangement for the channels that causes the desired swirl flow to exit on the outflow side of the catalyzer/swirl generator arrangement, i.e., at the outlet ends of the channels.

In order to reduce the pressure loss during the flow through the catalyzer/swirl generator arrangement, the slant of the channels in relation to the longitudinal center axis may increase in the flow direction, in particular steadily or in a stepped manner as well as continuously or progressively, whereby the slant of the channels may have the value zero at the inlet, i.e., the channels then extend parallel to the longitudinal center axis with their inlet.

According to a special further development, the catalyzer/swirl generator arrangement may comprise, radially to the longitudinal center axis, several layers of a corrugated or folded first web material whose corrugations or folds form the catalytically active or catalytically inactive channels. An intermediate layer of a flat or smooth second web material is arranged between two adjoining layers in a radial direction. This construction ensures that radially adjoining corrugations or folds are unable to project inside each other, so that the channels always have unchanging flow cross-sections.

BRIEF DESCRIPTION OF THE DRAWINGS

Preferred exemplary embodiments of the invention are shown in the drawings and are explained in more detail in the following description, wherein identical reference numbers refer to identical or functionally identical or similar components. The schematic drawings show in.

DETAILED DESCRIPTION OF THE PREFERRED EMBODIMENTS

Figure 1:
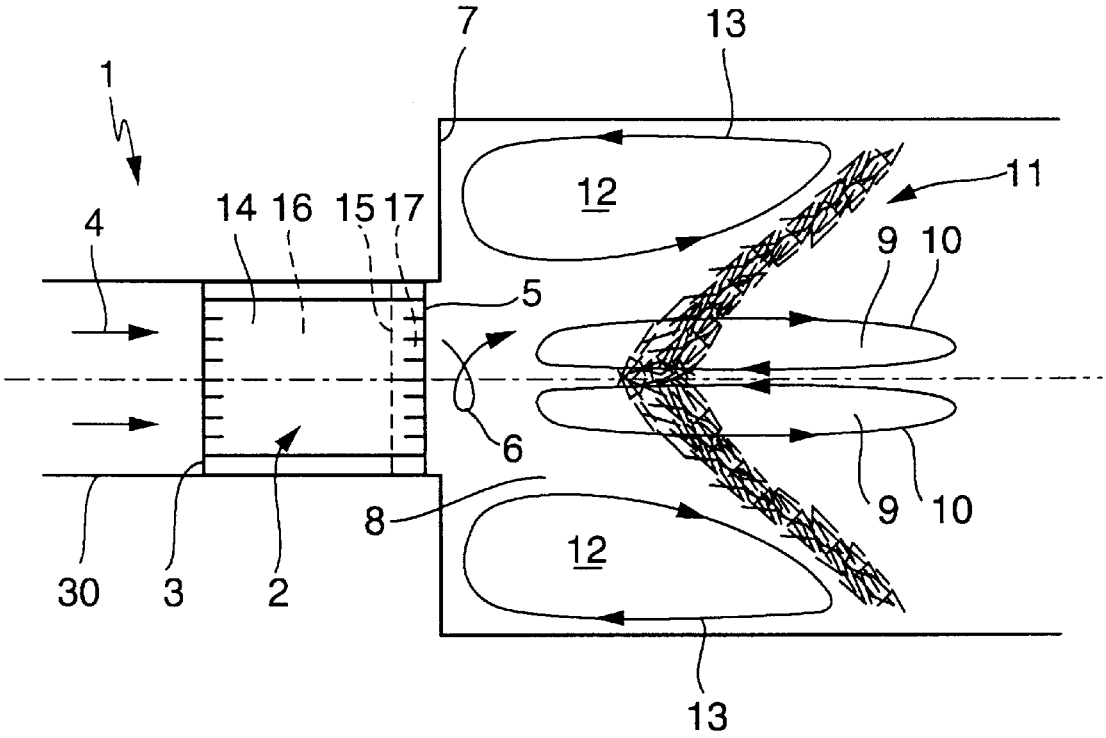
FIG. 1 is a greatly simplified principle view of a device according to the invention.

Referring initially to FIG. 1, a device 1 according to the invention comprises a flow-enabling catalyzer/swirl generator arrangement 2 to the inflow side 3 of which a gaseous fuel/oxidant mixture 4 is fed, symbolized in FIG. 1 by arrows. The device 1 forms a burner with a feed line 30, in which the catalyzer/swirl generator arrangement 2 is arranged. The catalyzer/swirl generator arrangement 2 according to the invention is constructed in such a way that part of the fuel/oxidant mixture 4 is burned in it, and that a swirl flow exits on an outflow side 5, which is symbolized by an arrow 6. The catalyzer/swirl generator arrangement 2 is arranged directly before an abrupt cross-section increase 7 formed at the inlet of a combustion chamber 8. This allows the swirl flow to immediately burst open, With a sufficiently high swirl value, a central recirculation zone 9 is therefore able to form in the combustion chamber 8. Corresponding vortices 10 are suggested by closed lines with arrows. The recirculation zone 9 forms a kind of anchor for a homogeneous flame front 11 in the combustion chamber 8. A stabilization of the flame front 11 is achieved in that the central vortices 10 support a mixing of the products of the homogeneous combustion in the combustion chamber 8 with the partially burned products of the catalytic combustion in the catalyzer/swirl generator arrangement 2. This corresponds to an internal waste gas recycling that effects an intensive preheating of the total mixture and at the same time reduces the local velocities to values that correspond to the flame velocity. This process is also supported in a corresponding manner by a recirculation zone 12 that is generated by the abrupt cross-section increase 7. Corresponding vortices 13 are also suggested here by closed lines with arrows. The flame stabilization achieved in this manner additionally supports the complete combustion and reduces the emission of noxious substances, such as, for example, CO and NOx, as a result of the improved mixing.

Such a device is used, for example, in power plant installations, and is used there to generate hot gases for operating a turbine, in particular a gas turbine.

As already explained above, part of the fuel/oxidant mixture 4 is burned while flowing through the catalyzer/swirl generator arrangement 2, resulting in an increase in the temperature of the supplied fuel/oxidant mixture at the inlet of the combustion chamber 8. These high temperatures additionally improve the flame stability and prevent the formation of pulsations.

The exact position of the flame front 11 in the combustion chamber 8 can be influenced by the geometry and/or arrangement and/or construction of the catalyzer/swirl generator arrangement 2.

The catalyzer/swirl generator arrangement 2 preferably consists of a catalyzer 14 that is constructed as a swirl generator. Also possible is a construction of the swirl generator and catalyzer as separate components that are positioned consecutively in the flow direction. Such an embodiment is additionally suggested in FIG. 1 with a broken line that symbolizes the boundary 15 between an upstream catalyzer 16 and a downstream swirl generator 17 directly following the catalyzer 16 downstream.

Figure 2:
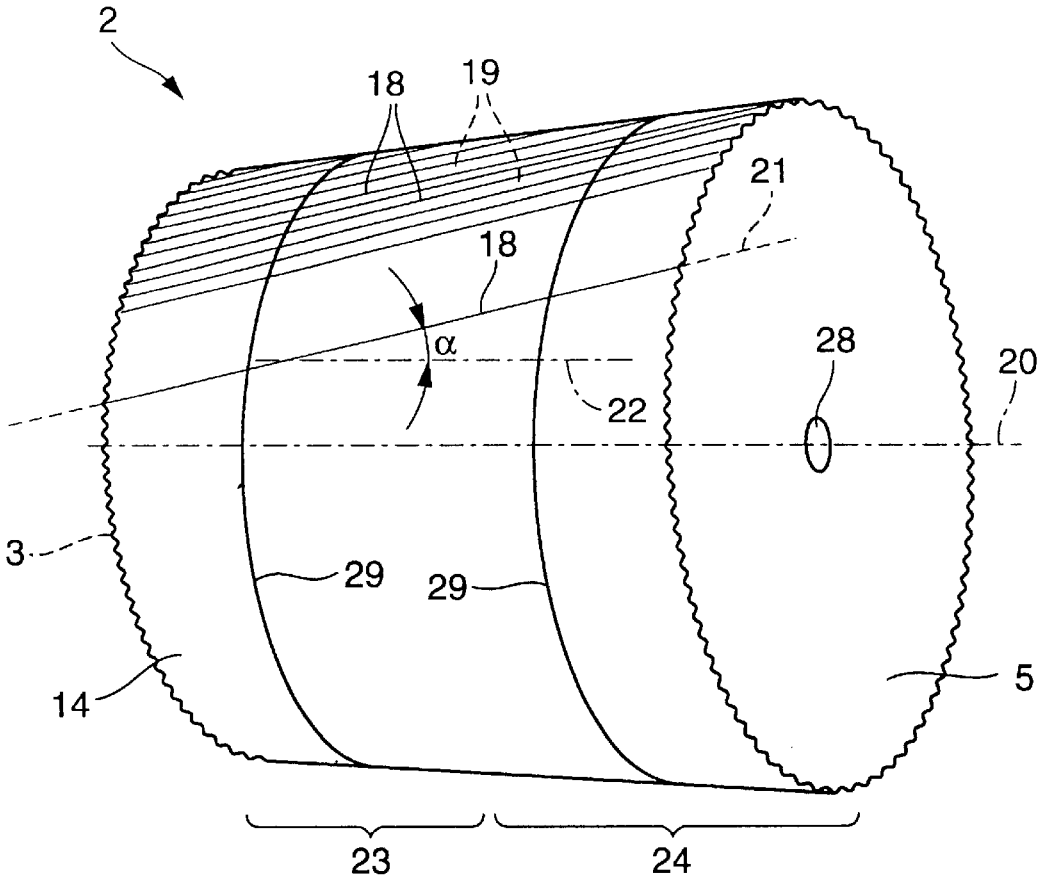
FIG. 2 is a perspective view onto a catalyzer/swirl generator arrangement in a preferred embodiment.
Figure 3:
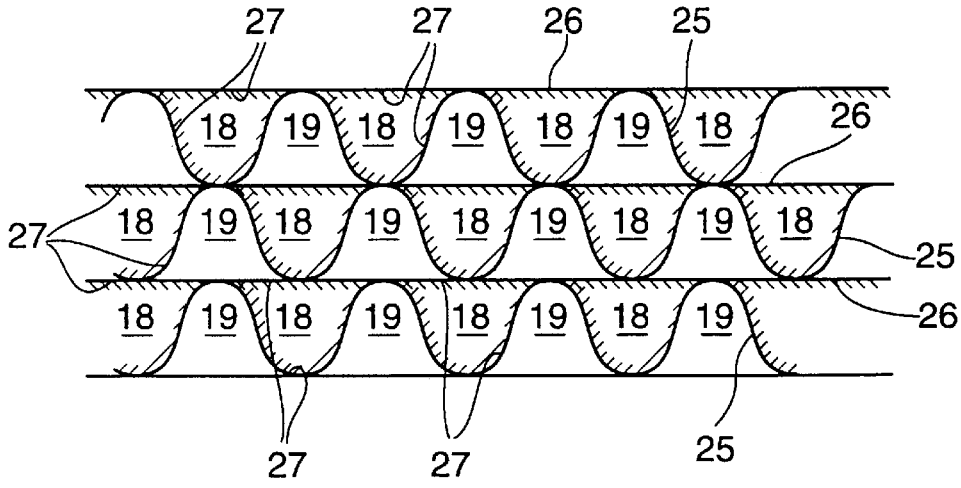
FIG. 3 is a partial section through the catalyzer/swirl generator arrangement according to FIG. 2.

According to FIGS. 2 and 3, the catalyzer/swirl generator arrangement 2 comprises several flow channels 18 and 19 extending essentially parallel to each other. Some of the channels are constructed as catalytically active channels 18, while the others are constructed as catalytically inactive channels 19. It is useful that catalytically active channels 18 and catalytically inactive channels 19 alternate, thus improving the cooling effect for the catalyzer 14 or the catalyzer/swirl generator arrangement 2. The channels 18, 19 are arranged so as to be distributed radially and circumferentially around a longitudinal center axis 20 of the catalyzer/swirl generator arrangement 2 that is here constructed cylindrically, in particular circular-cylindrically. The longitudinal center axis 20 hereby extends parallel to the main flow direction of the catalyzer/swirl generator arrangement 2.

In order to integrate the swirl generator into the catalyzer 14, the channels 18, 19 are slanted in relation to the longitudinal center axis 20, i.e., the longitudinal directions of the channels 18, 19 each extend slanted in relation to a straight line that extends parallel to the longitudinal center axis 20. This relationship is illustrated as an example in FIG. 2 using a single channel 18, i.e., a longitudinal direction 21 (drawn with a broken line) of this channel 18 is angled in relation to a straight line 22 (also drawn with a broken line) that extends parallel to the longitudinal center axis 20.

This angle of slant $\alpha$ must be selected large enough to ensure that the central recirculation zone 9 is able to form in the combustion chamber 8. In addition, the angle of slant $\alpha$ may also not be selected too large in order to prevent a too high pressure loss at the cross-section increase 7. At least in the case of channels 18, 19 arranged radially further out, suitable values for the angle range, for example, between 30° and 60°, which may correspond to, for example, swirl values $\Omega$ of 0.4 to 1.2. If the outflow side 5 of the catalyzer/swirl generator arrangement 2 is positioned immediately before the cross-section increase 7, the angle of slant $\alpha$, and thus the pressure loss of the arrangement, can be reduced.

In the embodiment according to FIG. 2, all channels 18, 19 have the same slant $\alpha$ in relation to the longitudinal center axis 20 along their entire length. In another embodiment, not shown here, the slant a of the channels 18, 19 in relation to the longitudinal center axis 20 can increase in the flow direction of the catalyzer/swirl generator arrangement 2. It is useful that this change in slant a takes place steadily and progressively. In particular, the slant may have the value $\alpha$=0° at the inflow side of the catalyzer/swirl generator arrangement 2. This design of the channels 18, 19 makes it possible to optimize the flow resistance of the catalyzer/swirl generator arrangement 2. In another embodiment, the slant $\alpha$ of the channels may increase radially from the inside to the outside. This means that for channels 18, 19 that are located radially further inside, the slant a can be smaller than for channels 18, 19 that are located radially further outside. These measures simplify the production of the catalyzer/swirl generator arrangement 2.

For example, the catalyzer/swirl generator arrangement 2 may have a first longitudinal section 23 comprising the inflow section 3 as well as a second longitudinal section 24 comprising the outflow section 5. These longitudinal sections 23, 24 are designated in FIG. 2 with brackets. The longitudinal sections 23, 24 may be—as is the case here—of approximately identical size. In a preferred embodiment, the channels 18 and 19 in the first longitudinal section 23 may extend parallel to the longitudinal center axis 20, while in the second longitudinal section 24 they have a slant in relation to the longitudinal center axis 20 that may optionally increase in the flow direction. This forms the swirl generator 17 in the rear longitudinal section 24 of the arrangement 2. It is useful that the second longitudinal section 24 extends over approximately one fifth, one quarter, or one third of the total length of the arrangement 2.

According to FIGS. 2 and 3, it is useful that the catalyzer/swirl generator arrangement 2 is constructed by placing a corrugated or folded first web material 25 onto a flat or smooth second web material 26. As a result, a layering occurs radially in relation to the longitudinal center axis 20, whereby the layers formed by the first web material 25 are separated radially from each other by intermediate layers formed from the second web material 26. In this construction, the second web material 26 ensures that the corrugations and folds of the first web material 25 of one layer are unable to project into the corrugations and folds of the first web material 25 of a radially adjoining layer. Rather, the intermediate layers made from the second web material 26 ensure unchanging channel cross-sections. The individual channels 18 and 19 are hereby formed by the corrugations or folds of the first web material 25. In order to construct the catalytically active channels 18, it is useful that one side of the first web material 25, in each case the top according to FIG. 3, can be coated with a catalytically active coating 27. The opposite underside of the first web material 25 is then uncoated, thus creating the catalytically inactive channels 19. Alternatively or additionally, the layers of the second web material 26 may also be coated on one side with the catalyzer coating 27 in order to form the catalytically active channels 18. It is useful that the web materials 25, 26 consist of a metal sheet that is appropriately preshaped and potentially coated.

Figure 7:
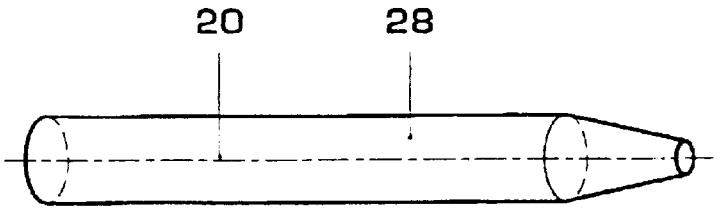
FIG. 7 is a perspective view of the outlet nozzle of the catalyzer/swirl generator arrangement according to FIG. 2.

The web materials 25 and 26 may be concentrically layered in relation to the longitudinal center axis 20. However, an embodiment in which the web materials 25 and 26 are layered helically in relation to the longitudinal center axis 20 is preferred. This arrangement allows for an especially simple method of producing the catalyzer/swirl generator arrangement 2:

The web materials 25 and 26 that were placed on top of each other are wound onto a spindle 28, which, after the winding, forms the center of the catalyzer/swirl generator arrangement 2 and extends concentrically to the longitudinal center axis 20. The spindle 28 is shown in FIG. 7 and includes an outlet nozzle.

The spindle 28 therefore carries the web material 25, 26, and its diameter size is selected so that the winding of the corrugated or folded first web material 25 can still be realized with justifiable expenditure. The complete winding can be secured, for example, with tension wires 29 that enclose the winding circumferentially and maintain its shape at least until the installation of the catalyzer/swirl generator arrangement 2 into a burner, etc.

It is useful that this spindle 28 is constructed so as to be able to influence the central recirculation zone 9 or the flame front 11 in the combustion chamber 11 (FIG. 1), in particular with respect to shape and position. The spindle 28, for example, is constructed as a flow pipe that enables a central flow through the catalyzer/swirl generator arrangement 2 by the fuel/oxidant mixture 4. It is useful that the tubular spindle 28 then has at its outlet end an outlet nozzle or outlet aperture, whereby it may also be useful to construct the outlet end so that it converges in the flow direction. These measures make it possible to change the aerodynamic values of the flow entering the combustion chamber 8, whereby said values influence the position and extension of the flame front 11 and/or central recirculation zone 9.

It is also possible to integrate a lance for the fuel and/or oxidizer injection into the spindle 28.

In order to be able to generate the desired swirl, the swirl-generating structure requires a minimum length L, obtained by dividing the channel diameter by the tangent of the angle of slant. The calculated length is relatively short, so that even the construction with separate catalyzer 16 and separate swirl generator 17, explained above in reference to FIG. 1, still has a relatively short length in the flow direction. In the integrated construction, the axial length of the catalyzer 14 constructed as a swirl generator, i.e., the axial length of the catalyzer/swirl generator arrangement 2, may depend on the requirements of the catalytic conversion of the system.

The integrated construction of the catalyzer/swirl generator arrangement 2 is also of special advantage if the arrangement 2, as explained above in reference to FIG. 1, has two or more longitudinal sections 23, 24, in which the channels 18, 19 differ from each other with respect to their slant. For example, the channels 18, 19 in the upstream first longitudinal section 23 are not slanted in relationship to the longitudinal center axis 20, so that they extend parallel to the main flow direction, while they are slanted in the downstream longitudinal section 24, and in this way form the swirl generator. The one-piece construction of the catalyzer/swirl generator arrangement 2 hereby reduces pressure losses during the transition between the consecutive longitudinal sections 23, 24. While in a construction with separate longitudinal sections 23, 24 a minimum distance between the consecutive longitudinal sections 23, 24 must be maintained for the transition from one longitudinal section 23 to the other longitudinal section 24 in order to achieve sufficient mixing, such a transition and mixing area is not required in the one-piece construction of the longitudinal sections 23, 24, so that the arrangement 2 according to the invention can be constructed especially short.

Figure 4:
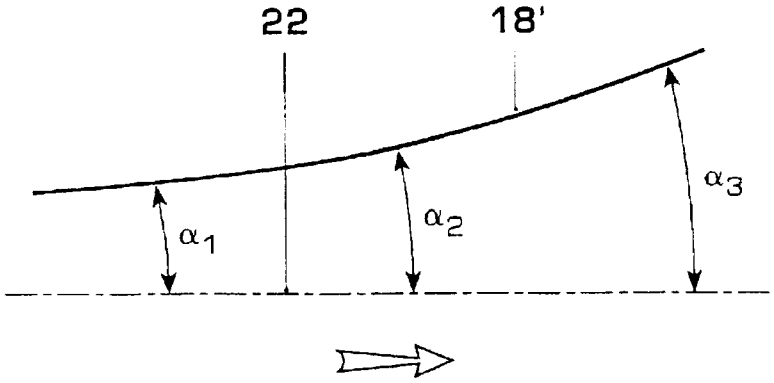
FIG. 4 is a partial section through the catalyzer/swirl generator according to a first alternative embodiment.

With reference to FIG. 4, a first alternative embodiment of the invention shows an increasing slant (angles $\alpha_1$,$\alpha_2$, and $\alpha_3$) of the channel 18' in the flow direction.

Figure 5:
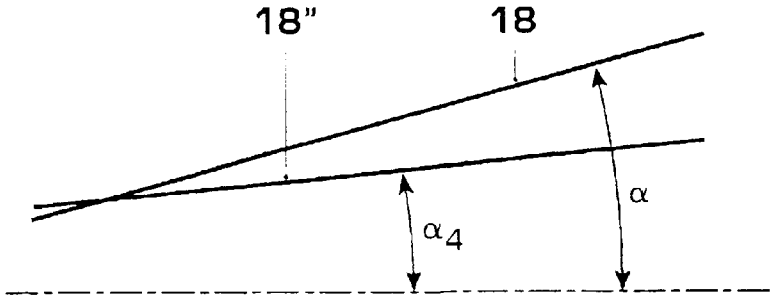
FIG. 5 is a partial section through the catalyzer/swirl generator according to a second alternative embodiment.

FIG. 5 illustrates a second alternative embodiment of the present invention, wherein the channel radially increases from the inside to the outside, wherein 18 designates the outside and 18" designates an inner channel of the catalyzer/swirl generator arrangement 2. According to this embodiment, the inner angle As is smaller than the outer radial angle $\alpha$.

Figure 6:
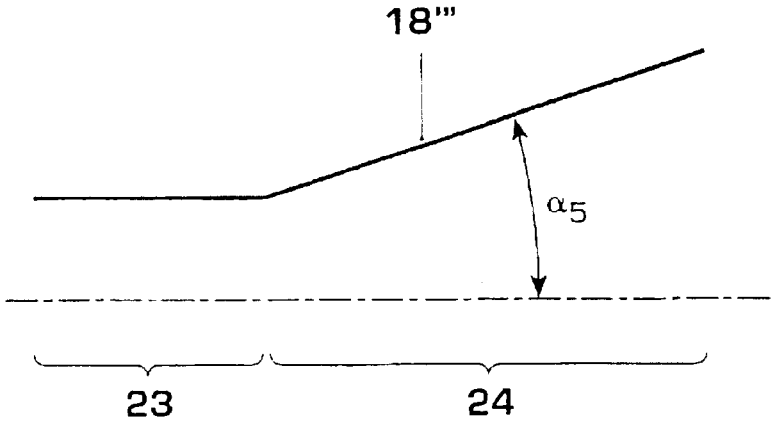
FIG. 6 is a partial section through the catalyzer/swirl generator according to a third alternative embodiment.

With reference to FIG. 6, the channel 18''', which is arranged in parallel to the longitudinal center axis 20 in a first longitudinal section 23 of the catalyzer/swirl generator arrangement 2, is only slanted in relation to the longitudinal center axis 20 in a second longitudinal section 24 of the catalyzer/swirl generator arrangement 2 (see angle $\alpha_5$).

What is claimed is:

1. A device for burning a gaseous fuel/oxidant mixture, comprising:

a flow-enabling catalyzer/swirl generator arrangement in which part of the fuel/oxidant mixture is burned and which generates a swirl flow, wherein the catalyzer/ swirl generator arrangement comprises several flow channels which are continuous through the whole catalyzer/swirl generator arrangement, some of said flow channels being constructed catalytically active, and the others of said flow channels being constructed catalytically inactive, wherein the flow channels are arranged distributed around a longitudinal center axis of the catalyzer/swirl generator arrangement that extends in the main flow direction of the catalyzer/swirl generator arrangement, and the flow channels are slanted in relation to the longitudinal center axis of the catalyzer/swirl generator arrangement in such a way that the longitudinal directions of the flow channels each extend slanted in relation to a straight line that extends parallel to the longitudinal center axis of the catalyzer/swirl generator arrangement.

2. The device according to claim 1, wherein the catalyzer/swirl generator arrangement comprises a catalyzer and a swirl generator, the swirl generator directly following the catalyzer in a downstream direction.

3. The device according to claim 1, wherein the catalyzer/swirl generator arrangement comprises a catalyzer that is constructed as a swirl generator.

4. The device according to one of claims 1 to 3, wherein the catalyzer/swirl generator arrangement is arranged directly upstream from an abrupt cross-section increase at the entrance of a combustion chamber.

5. The device according to claim 1, wherein the slant of the flow channels in relation to the longitudinal center axis of the catalyzer/swirl generator arrangement increases in the flow direction.

6. The device according to claim 1, wherein flow channels located further radially inward in relation to the longitudinal center axis of the catalyzer/swirl generator arrangement have a slant that is smaller than the slant of flow channels located further radially outward.

7. The device according to claim 1, wherein the flow channels extend in a first longitudinal section comprising the inflow side of the catalyzer/swirl generator arrangement parallel to the longitudinal center axis of the catalyzer/swirl generator arrangement, and the flow channels are slanted in relation to the longitudinal center axis of the catalyzer/swirl generator arrangement in a second longitudinal section comprising the outflow side of the catalyzer/swirl generator arrangement.

8. The device according to claim 1, wherein the catalyzer/swirl generator arrangement comprises layers of a corrugated or folded first web material whose corrugations or folds form the flow channels, the layers arranged in a radial direction relative to a longitudinal center axis that extends parallel to the main flow direction of the catalyzer/swirl generator arrangement, and an intermediate layer of a flat or smooth second web material is arranged between two adjoining layers in a radial direction.

9. The device according to claim 8, wherein the web materials are layered in relation to the longitudinal center axis at least one of concentrically and helically.

10. The device according to claim 8, wherein the catalyzer/swirl generator arrangement comprises a central spindle that extends concentrically to the longitudinal center axis and carries the web materials.

11. The device according to claim 10, wherein the spindle is constructed so that it aerodynamically influences at least one of a recirculation zone and a flame front in a combustion chamber arranged downstream from the catalyzer/swirl generator arrangement.

12. The device according to claim 10, wherein the spindle is constructed as a flow pipe through which part of the fuel/oxidant mixture centrally flows through the catalyzer/swirl generator arrangement.

13. The device according to claim 12, wherein the spindle is constructed to have an outlet end that is configured to at least one of converge at the outlet end of the spindle, form an outlet aperture at the outlet end and form an outlet nozzle at the outlet end.

14. A catalyzer/swirl generator arrangement for a device for burning a fuel/oxidant mixture in a power plant installation, wherein the catalyzer/swirl generator arrangement is constructed so that the fuel/oxidant mixture is able to flow through it, and the fuel/oxidant mixture is provided with a swirl when flowing through the catalyzer/swirl generator arrangement and is partially burned, wherein the catalyzer/swirl generator arrangement comprises several flow channels which are continuous through the whole catalyzer/swirl generator arrangement, some of said flow channels being constructed catalytically active, and the others of said flow channels being constructed catalytically inactive, wherein the flow channels are arranged distributed around a longitudinal center axis of the catalyzer/swirl generator arrangement that extends in the main flow direction of the catalyzer/swirl generator arrangement, and the flow channels are slanted in relation to the longitudinal center axis of the catalyzer/swirl generator arrangement in such a way that the longitudinal directions of the flow channels each extend slanted in relation to a straight line that extends parallel to the longitudinal center axis of the catalyzer/swirl generator arrangement.

15. A method for producing a catalyzer/swirl generator arrangement according to claim 14, wherein a smooth or flat second web material is placed onto a corrugated or folded first web material, and wherein the web materials placed on top of each other are wound onto a spindle.

16. The method according to claim 15, wherein the corrugations or folds in the first web material extend at a slant in relation to the longitudinal axis of the spindle.

17. The method according to claim 15 or 16, wherein the corrugations or folds following each other in the direction the web materials are wound onto the spindle are constructed alternately catalytically active and catalytically inactive.

18. A method for burning a fuel/oxidant mixture in an application including in a power plant installation, comprising:

providing a catalyzer/swirl generator arrangement wherein the fuel/oxidant mixture is provided with a swirl and is partially burned catalytically before being fed into a combustion chamber, wherein the catalyzer/swirl generator arrangement comprises several flow channels which are continuous through the whole catalyzer/swirl generator arrangement, some of said flow channels being constructed catalytically active, and the others of said flow channels being constructed catalytically inactive, wherein the flow channels are arranged distributed around a longitudinal center axis of the catalyzer/swirl generator arrangement that extends in the main flow direction of the catalyzer/swirl generator arrangement, and the flow channels are slanted in relation to the longitudinal center axis of the catalyzer/swirl generator arrangement in such a way that the longitudinal directions of the flow channels each extend slanted in relation to a straight line that extends parallel to the longitudinal center axis of the catalyzer/swirl generator arrangement.

* * * * *